US005231707A

United States Patent [19]

Ashley et al.

[11] Patent Number: 5,231,707

[45] Date of Patent: Aug. 3, 1993

[54] SPLASH GUARD APPARATUS

[76] Inventors: Kevin M. Ashley; Jackie M. Ashley, both of 4924 Calmont Ave., Fort Worth, Tex. 76107; Rachel P. Jordan, SSR Box 106, Weatherford, Tex. 76086

[21] Appl. No.: 772,552

[22] Filed: Oct. 7, 1991

[51] Int. Cl.[5] ..... A47K 3/14

[52] U.S. Cl. ..... 4/557; 4/661; 4/609; 446/227; 160/376

[58] Field of Search ..... 4/557, 558, 559, 580, 4/605, 607, 608, 609, 658, 661; 446/267, 227, 168; 160/222, 226, 375, 376, 130, 135, DIG. 6

[56] References Cited

U.S. PATENT DOCUMENTS

| | | | |
|---|---|---|---|
| 957,906 | 5/1910 | Ried | 160/375 |
| 1,211,191 | 1/1917 | Levey | 160/376 |
| 1,385,517 | 7/1921 | Blackburn | 446/168 |
| 1,696,081 | 12/1928 | Ellis | 160/376 |
| 1,722,572 | 7/1929 | Helin | 160/376 |
| 1,944,440 | 1/1934 | Lehman | 4/607 X |
| 2,095,645 | 10/1937 | Lewis | 4/607 |
| 3,335,784 | 8/1967 | Risk et al. | 4/557 X |
| 3,577,675 | 5/1971 | Kohner | 446/227 X |
| 4,057,244 | 11/1977 | Gasper | 4/661 X |
| 4,620,332 | 11/1986 | Laird | 4/609 X |
| 4,888,835 | 12/1989 | Baumann | 4/609 |
| 4,891,850 | 1/1990 | Borstcher | 4/609 |
| 5,012,537 | 5/1991 | Underwood | 4/580 X |
| 5,078,642 | 1/1992 | Glessner | 446/168 X |
| 5,123,129 | 6/1992 | Lyons | 4/557 |

FOREIGN PATENT DOCUMENTS

| | | | |
|---|---|---|---|
| 0014488 | 11/1934 | Australia | 160/376 |
| 0204321 | 12/1986 | European Pat. Off. | 4/557 |
| 0457072 | 11/1991 | European Pat. Off. | 4/609 |
| 2754637 | 6/1979 | Fed. Rep. of Germany | 4/607 |

*Primary Examiner*—William A. Cuchlinski, Jr.
*Assistant Examiner*—John L. Beres
*Attorney, Agent, or Firm*—Leon Gilden

[57] ABSTRACT

An apparatus is arranged for mounting to a top surface of a bathtub extensible to interfit between opposing side walls receiving the bathtub, with the apparatus including a hinge portion to permit accommodation of various irregularities relative to a bathtub top surface.

5 Claims, 4 Drawing Sheets

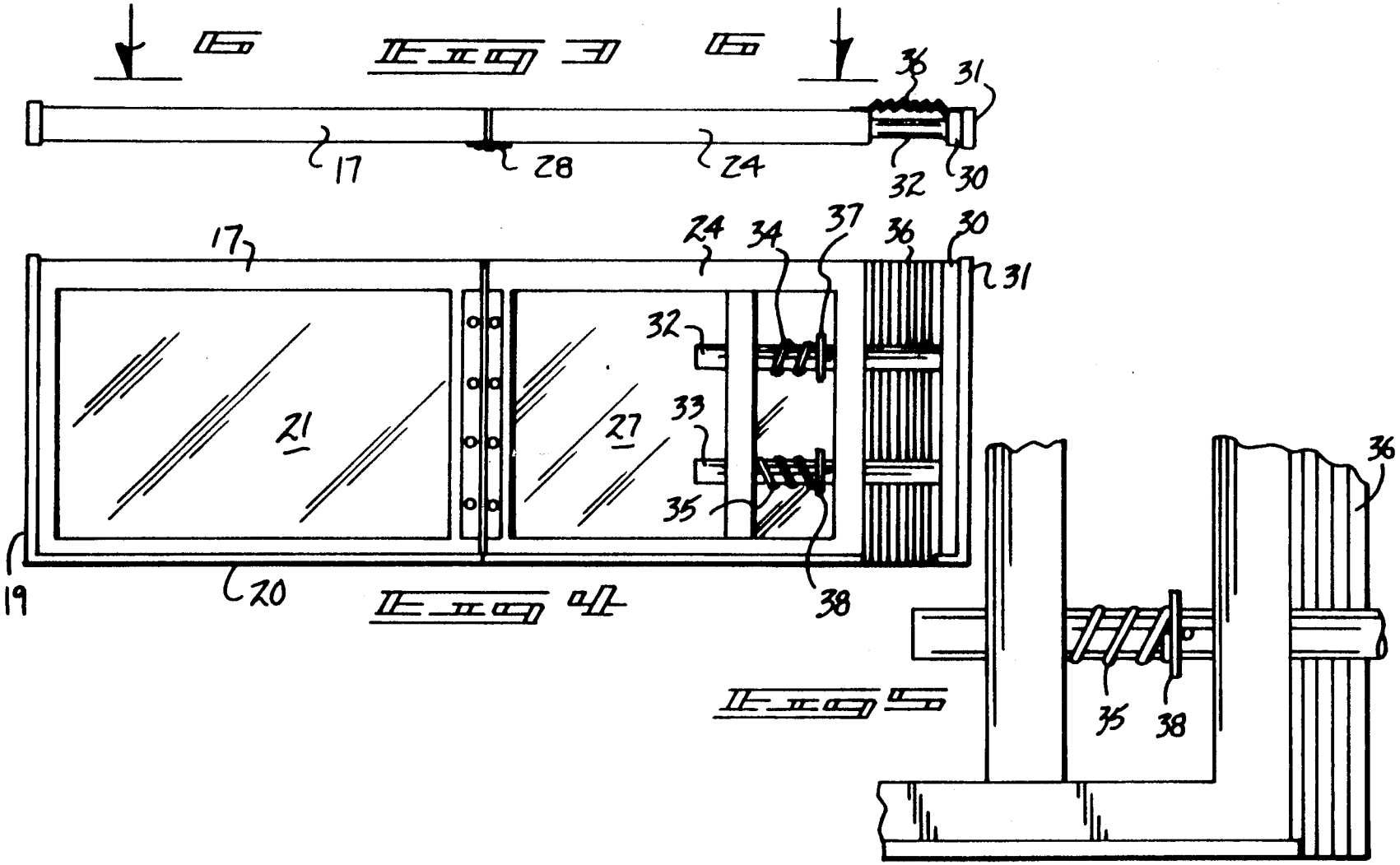
36
38
35
31
30
32
36
37
34
24
28
17
21
20
19
33
27

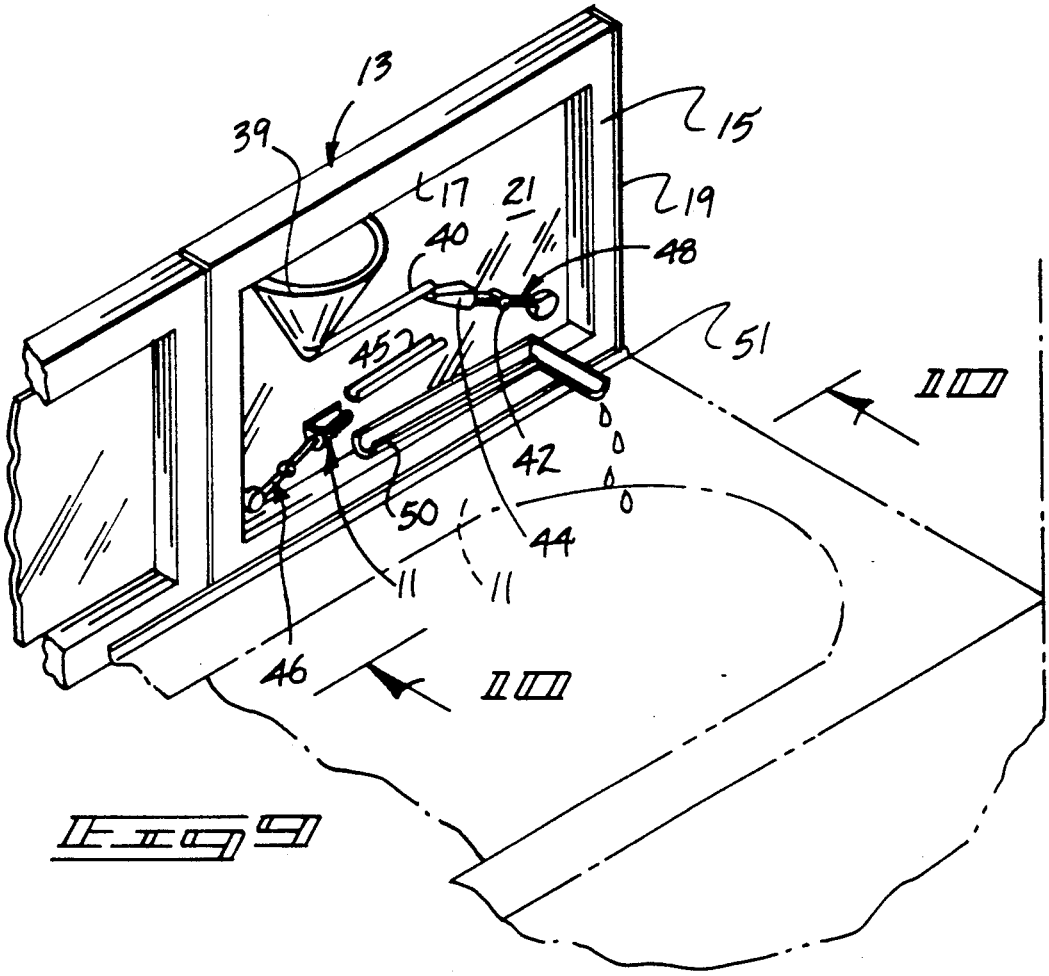
FIG 9
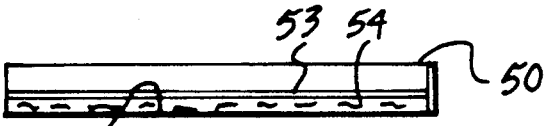
FIG 11
FIG 10
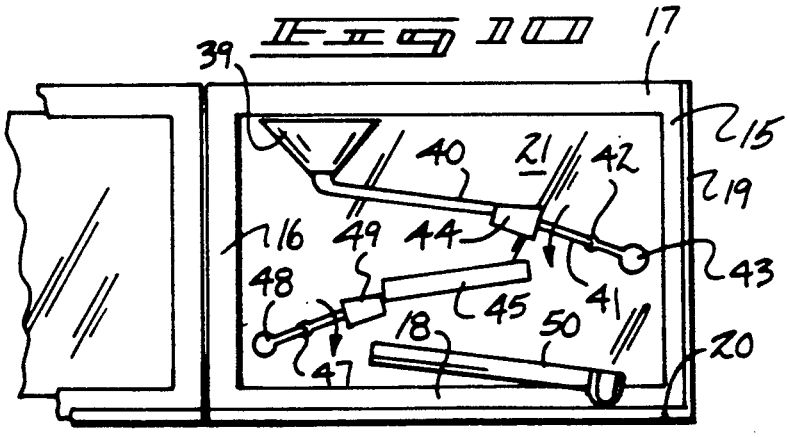

SPLASH GUARD APPARATUS

BACKGROUND OF THE INVENTION

1. Field of the Invention

The field of invention relates to bathtub apparatus, and more particularly pertains to a new and improved splash guard apparatus arranged for shielding a surrounding floor surface relative to a bathtub from splashing water.

2. Description of the Prior Art

Various splash guard apparatus has been utilized in the prior art for providing a shielding structure relative to a bathtub environment. Typically, the prior art has been of a relatively awkward construction or selectively of unitary configuration limiting accommodation relative to various bathtub surfaces. Prior art structure is exemplified in U.S. Pat. No. 3,855,642 to Blitch wherein a unitary shield structure is arranged relative to a bathtub member for positioning on opposed sides of an associated shower curtain.

U.S. Pat. No. 4,620,332 to Laird sets forth a bathtub splash collector formed with a trough-like member directing water into a reservoir that is projected beyond the associated bathtub.

U.S. Pat. No. 4,765,001 to Smith sets forth a further splash structure mounted to opposed sides of a shower curtain arrangement.

As such, it may be appreciated that there continues to be a need for a new and improved splash guard apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of splash guard apparatus now present in the prior art, the present invention provides a splash guard apparatus wherein the same is arranged for coextensive mounting relative to a top surface of a bathtub top wall providing a barrier for splashing water. As such, the general purpose of the present invention, which will be described subsequently in greater detail, is to provide a new and improved splash guard apparatus which has all the advantages of the prior art splash guard apparatus and none of the disadvantages.

To attain this, the present invention provides an apparatus arranged for mounting to a top surface of a bathtub extensible to interfit between opposing side walls receiving the bathtub, with the apparatus including a hinge portion to permit accommodation of various irregularities relative to a bathtub top surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved splash guard apparatus which has all the advantages of the prior art splash guard apparatus and none of the disadvantages.

It is another object of the present invention to provide a new and improved splash guard apparatus which may be easily and efficiently manufactured and marketed.

It is a further object of the present invention to provide a new and improved splash guard apparatus which is of a durable and reliable construction.

An even further object of the present invention is to provide a new and improved splash guard apparatus which is susceptible of a low cost of manufacture with regard to both materials and labor, and which accordingly is then susceptible of low prices of sale to the consuming public, thereby making such splash guard apparatus economically available to the buying public.

Still yet another object of the present invention is to provide a new and improved splash guard apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic top view of the instant invention.

FIG. 4 is an orthographic frontal view of the invention, taken in elevation.

FIG. 5 is an orthographic enlarged view of the guide rail and collar structure utilized by the invention.

FIG. 9 is an isometric illustration of a modified aspect of the invention.

FIG. 10 is an orthographic view, taken along the lines 10—10 of FIG. 9 in the direction indicated by the arrows.

FIG. 11 is an orthographic view, taken along the lines 11—11 of FIG. 9 in the direction indicated by the arrows.

DESCRIPTION OF THE PREFERRED EMBODIMENT

Figure 1:
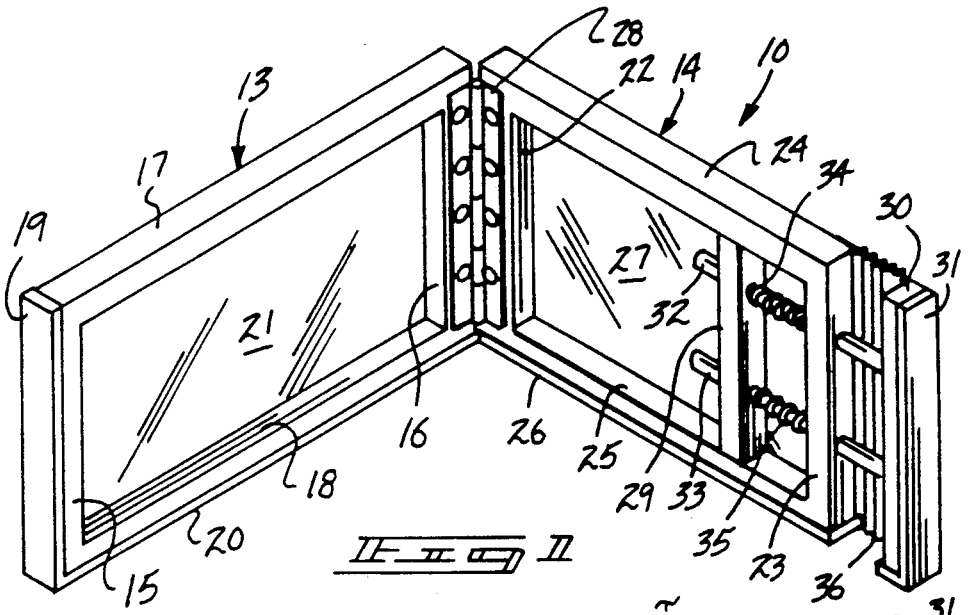
FIG. 1 is an isometric illustration of the instant invention.
Figure 2:
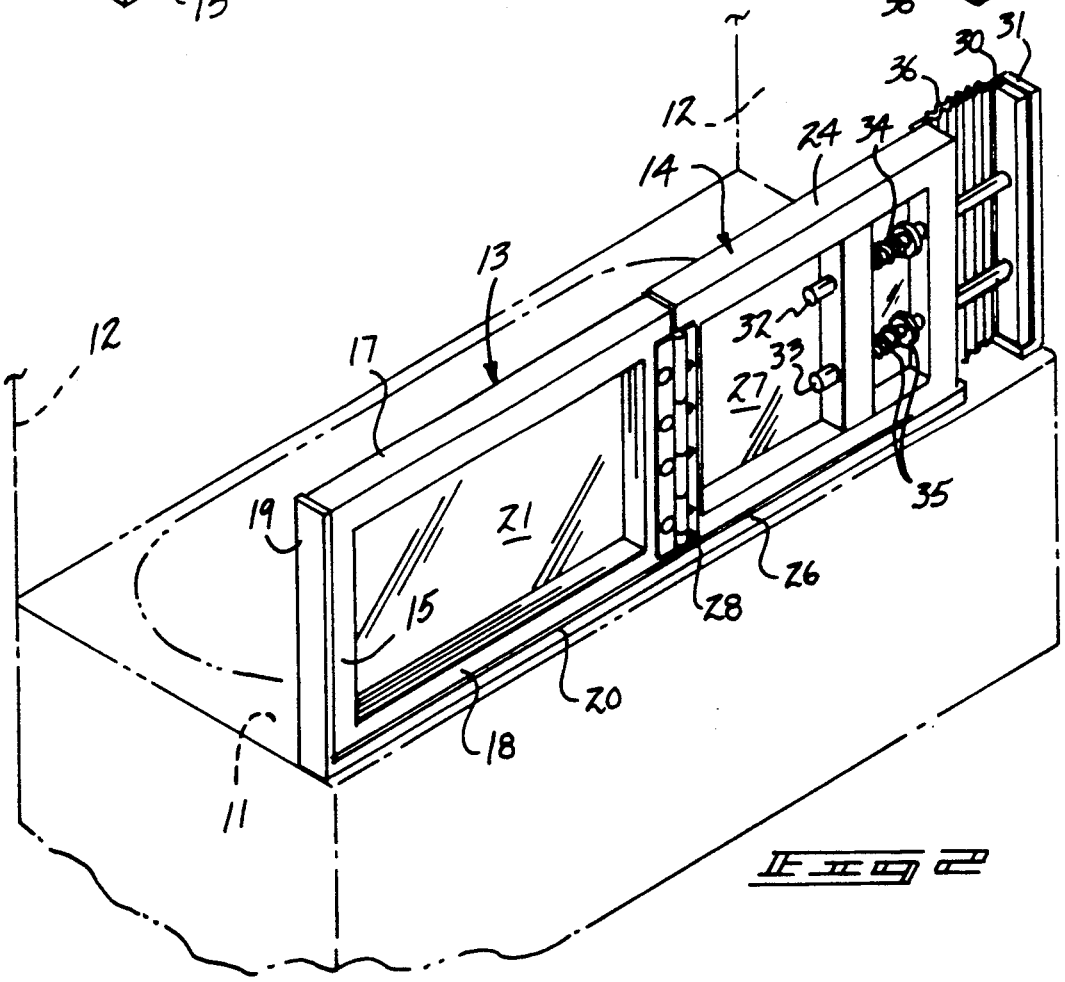
FIG. 2 is an isometric illustration of the invention mounted to an associated bathtub structure.
Figure 7:
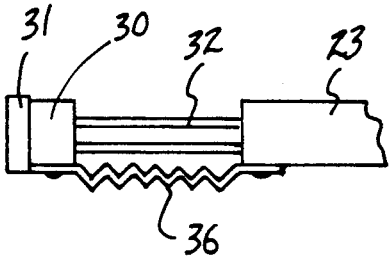
FIG. 7 is a top partial view of the accordion structure mounted relative to the apparatus.
Figure 8:
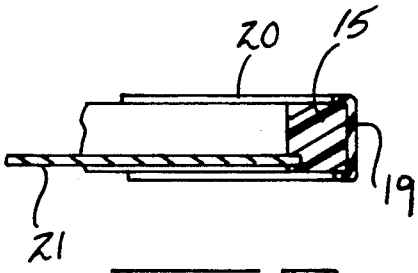
FIG. 8 is a cross-sectional illustration, taken along the lines 8—8 of FIG. 6 in the direction indicated by the arrows.
Figure 6:
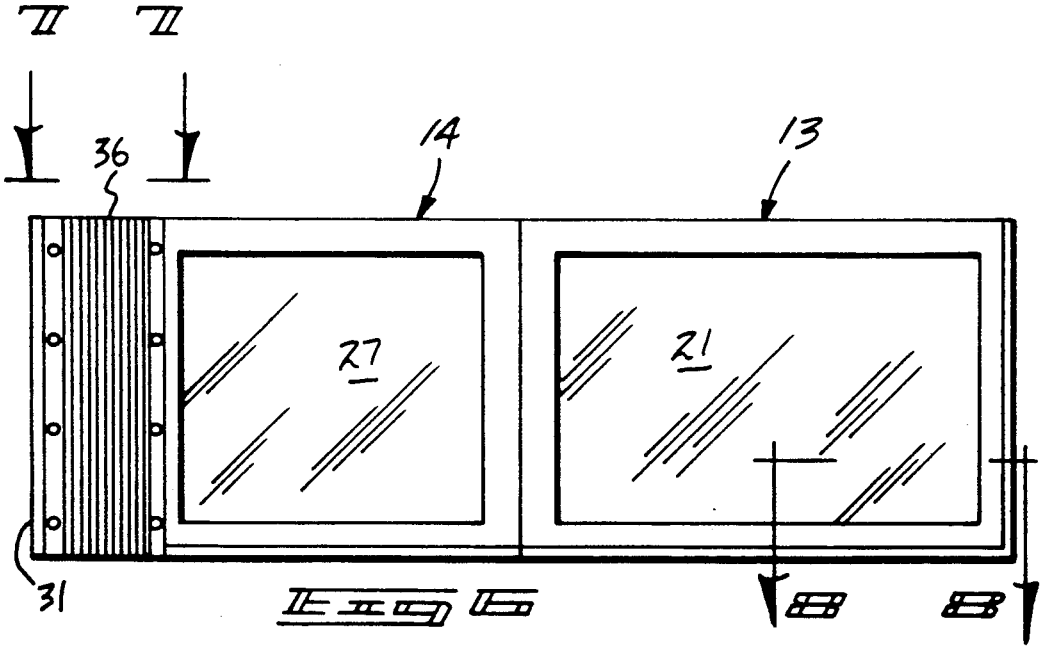
FIG. 6 is an orthographic view, taken along the lines 6—6 of FIG. 3 in the direction indicated by the arrows.

With reference now to the drawings, and in particular to FIGS. 1 to 11 thereof, a new and improved splash guard apparatus embodying the principles and concepts of the present invention and generally designated by the reference numeral 10 will be described.

More specifically, the splash guard apparatus 10 of the instant invention essentially comprises the use of the organization in association with a top surface of a bathtub wall 11 that is typically arranged between spaced side walls 12 and extending generally orthogonally and upwardly of the top wall 11. The apparatus 10 includes a first rectilinear frame 13 hingedly mounted to a second rectilinear frame 14. The first frame 13 includes a first frame side wall 15 spaced from a first frame second side wall 16 in a generally parallel relationship. further, a first frame top wall 17 is spaced from and parallel a first frame bottom wall 18. A first sealing strip 19 is coextensive with the first frame first side wall 15 and a second resilient sealing strip 20 is coextensive with the first frame bottom wall 18. A first frame transparent window 21 is fixedly mounted within the first rectilinear frame 13 between the aforenoted walls 15-18. The second rectilinear frame 14 includes a second frame first side wall 22 spaced from and parallel a second frame second side wall 23. A second frame top wall 24 is spaced from and parallel a second frame bottom wall 25. A third resilient sealing strip 26 is coextensive with the second frame bottom wall 25, as illustrated. A second frame transparent window 27 is mounted coextensively within the second rectilinear frame 14, as illustrated in the FIGS. 1 and 2 for example. A hinge member 28 hingedly mounted to the first frame second side wall 16 and the second frame first side wall 22 permits pivotment of the first frame 13 relative to the second frame 14.

A brace leg 29 is mounted orthogonally between the second frame top wall 24 and the second frame bottom wall 25 in a spaced parallel relationship relative to the second frame second side wall 23. A sealing leg 30 is spaced parallel to and exteriorly of the second rectilinear frame and the second rectilinear frame second side wall 23. A fourth resilient sealing strip 31 is mounted to an exterior surface and coextensive with the sealing leg 30, as illustrated. A first rail and second rail 32 and 33 respectively are orthogonally and fixedly mounted to the sealing leg 30 in a spaced parallel relationship and are slidably directed through the second frame second side wall 23 and the brace leg 29. A first rail collar 37 is mounted to the first rail 32 and a second rail collar 38 is mounted to the second rail 33 between the brace leg 29 and the sealing leg 30 capturing a first spring 34 between the first collar 37 and the brace leg 29 and a second spring 35 between the second collar 38 and the brace leg 29 to normally bias the sealing leg 30 in an extended orientation relative to the second frame second side wall 23. An accordion screen 36 is of a height coextensive with a predetermined length of the second frame second side wall 23 and the sealing leg 30 to provide for a fluid impervious shield that is extensible and contractible relative to the sealing leg 30 and the second frame second side wall 23.

The FIGS. 10 and 11 illustrate a modified aspect of the invention, including an amusement device mounted to the interior surface of the first frame transparent window 21 for amusement of a child and the like positioned within the bathtub structure. A funnel member 39 is mounted adjacent to and whose axis is orthogonally oriented relative to the first frame top wall 17 mounted to the transparent window 21. An outlet tube 40 in fluid communication with a lower terminal end of the funnel member 39 is canted downwardly relative to the funnel member 39, and whose free terminal end is positioned above a first lever cup member 44 formed at a forward terminal end of a first lever 41 about a first lever pivot axis 42. A counter-weight 43 mounted at a rear distal end of the first lever 41 is of a greater weight than the cup member 44 to permit upward canting of the first lever 41, as illustrated, whereupon directing of fluid into the cup member 44 effects downward pivotment of the first lever 41 directing said fluid into a first trough 45. The first trough 45 is canted downwardly relative to the first lever cup member in the downwardly rotated orientation to effect directing of fluid along the first trough 45 onto a second lever cup member 49 of a second lever 46 pivotally mounted about a second lever pivot axis 47. The second lever 46 includes a second lever counter-weight 48 that as in the first lever 41 is of a greater weight than the cup member 49 when the cup member 49 is empty. Upon filling of the cup member 49 with fluid from the first trough 45, the second lever 46 rotates downwardly and is received within a second trough 50 of a generally "L" shaped configuration whose outlet leg 51 projects exteriorly and beyond the first frame transparent window 21 and the associated first frame 13. As illustrated in FIG. 11, the second trough 50 includes a second trough floor 52 including a gelatin layer 53 extending thereabove in a sealing relationship relative to the floor to encapsulate a bath oil liquid 54 therewithin. As fluid is directed above the gelatin layer 53, the gelatin layers is dissolved directing the bath oil liquid 54 into the associated bathtub through the second trough outlet leg 51. The second trough accordingly includes the gelatin encapsulating members replaced relative to the floor for replenishment thereof in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A splash guard apparatus, comprising, a first rectilinear frame hingedly mounted to a second rectilinear frame, the first rectilinear frame including a first frame first side wall spaced from and parallel a first frame second side wall, and a first frame top wall spaced from and parallel a first frame bottom wall, and a first resilient sealing strip coextensive with and fixedly secured to an exterior surface of the first frame first side wall, and a second resilient sealing strip fixedly mounted to and coextensive with the first frame bottom wall, and a first frame transparent window fixedly mounted within and coextensively directed between the first frame first side wall, the first frame second side wall, the first frame top wall, and the first frame bottom wall, and the second rectilinear frame including a second frame first side wall spaced from and parallel a second frame second side wall, and a second frame top wall spaced from and parallel a second frame bottom wall, and a third resilient sealing strip coextensive with and fixedly secured to an exterior surface of the second frame bottom wall, and a second frame transparent window fixedly mounted within and coextensive between the second frame first side wall, the second frame second side wall, the second frame top wall, and the second frame bottom wall, and a hinge member secured to the first frame second side wall and the second frame first side wall to hingedly mount the first rectilinear frame relative to the second rectilinear frame, and a brace leg fixedly mounted to the second frame top wall and the second frame bottom wall spaced from the second frame second side wall in a parallel relationship, and a sealing leg reciprocatably mounted relative to the second frame arranged parallel to and coextensive with the second frame second side wall, with the sealing leg including a fourth resilient sealing strip mounted coextensively to an exterior surface of the sealing leg, and the sealing leg including a first rail and a second rail fixedly and orthogonally mounted to the sealing leg, wherein the first rail and second rail are in a parallel relationship and are slidably directed through the second frame second side wall and the brace leg.

2. An apparatus as set forth in claim 1 including a first rail collar mounted fixedly to the first rail between the brace leg and the sealing leg, and a second collar fixedly mounted to the second rail between the brace leg and the sealing leg, and a first spring captured between the first collar and the brace leg, and a second spring captured between the second collar and the brace leg to normally bias the sealing leg in an extended orientation relative to the second frame second side wall.

3. An apparatus as set forth in claim 2 including an accordion screen defined by a predetermined height, wherein the sealing leg and the second frame second side wall are equal to the predetermined height and the accordion screen is mounted to the second frame second side wall and the sealing leg.

4. An apparatus as set forth in claim 3 including a funnel member fixedly mounted to the first frame transparent window adjacent the first frame top wall, wherein the funnel member includes a funnel member axis, the funnel member axis oriented orthogonally relative to the first frame top wall, and an outlet tube secured to a lower terminal end of the funnel member, the outlet tube including a free end spaced from the funnel member and positioned above a cup member, the cup member fixedly mounted to a forward terminal end of a first lever, the first lever including a pivot axis orthogonally mounted to the interior surface of the first frame transparent window, and the first lever including a counter-weight mounted at a rear terminal end of the first lever, wherein the counter-weight is defined by a predetermined weight greater than the cup member, whereupon projection of fluid into the cup member effects pivotment downwardly of the cup member, and a first trough fixedly mounted to the interior surface of the first frame transparent window positioned below the cup member to receive the cup member, wherein the first trough is canted downwardly relative to the cup member, and the first trough includes a lower distal end positioned above a second lever cup member, the second lever cup member mounted to a forward terminal end of a second lever, the second lever including a second lever pivot axis fixedly mounted to the interior surface of the first frame transparent window and parallel to the first lever pivot axis, and including a second lever counter-weight defined by a further predetermined weight greater than a further weight defined by the cup member, whereupon directing of fluid in the cup member effects downward pivotment of the second lever cup member, and a second trough fixedly mounted to the interior surface of the transparent window below the second lever cup member, the second trough including an outlet leg orthogonally oriented relative to the interior surface of the first frame transparent window.

5. An apparatus as set forth in claim 4 wherein the second trough includes a second trough floor, and a gelatin layer spaced above the floor containing a bath oil liquid therewithin, whereupon presentation of a fluid directed onto the gelatin layer effects dissolving of the gelatin layer directing the bath oil liquid to flow along the outlet leg into an associated bathtub.

* * * * *